US005946917A

United States Patent [19]

Hums et al.

[11] Patent Number: 5,946,917

[45] Date of Patent: Sep. 7, 1999

[54] CATALYTIC COMBUSTION CHAMBER OPERATING ON PREFORMED FUEL, PREFERABLY FOR A GAS TURBINE

[75] Inventors: Erich Hums, Hessdorf; Nicolas Vortmeyer, Essen, both of Germany

[73] Assignee: Siemens Aktiengesellschaft, Munich, Germany

[21] Appl. No.: 08/990,034

[22] Filed: Dec. 12, 1997

Related U.S. Application Data

[63] Continuation of application No. PCT/DE96/01020, Jun. 11, 1996.

[30] Foreign Application Priority Data

Jun. 12, 1995 [DE] Germany ..... 195 21 356

[51] Int. Cl.[6] ..... F23R 3/40

[52] U.S. Cl. ..... 60/723; 60/39.12; 431/7; 431/353

[58] Field of Search ..... 60/723, 737, 752, 60/39.06, 39.12; 431/7, 353

[56] References Cited

U.S. PATENT DOCUMENTS

| | | | |
|---|---|---|---|
| 2,941,361 | 6/1960 | Spalding . | |
| 3,032,991 | 5/1962 | Vdoviak . | |
| 3,113,885 | 12/1963 | Teague | 60/723 |
| 4,432,207 | 2/1984 | Davis, Jr. et al. . | |
| 4,603,547 | 8/1986 | Pfefferle et al. . | |
| 4,787,208 | 11/1988 | DeCorso | 60/723 |
| 5,048,284 | 9/1991 | Lywood et al. . | |
| 5,313,785 | 5/1994 | Althaus et al. | 60/39.45 |
| 5,355,668 | 10/1994 | Weil et al. | 60/723 |
| 5,368,475 | 11/1994 | Suppiah et al. . | |
| 5,413,879 | 5/1995 | Domeracki et al. | 429/30 |
| 5,461,864 | 10/1995 | Betta et al. | 60/723 |

FOREIGN PATENT DOCUMENTS

| | | | |
|---|---|---|---|
| 38 09 226 A1 | 9/1988 | Germany . | |
| 37 23 603 A1 | 1/1989 | Germany . | |
| 41 33 337 A1 | 4/1992 | Germany . | |
| 42 10 543 A1 | 10/1993 | Germany . | |
| 92009849 | 6/1992 | Japan | 431/7 |
| 2 196 392 | 4/1988 | United Kingdom . | |
| 2 268 694 | 1/1994 | United Kingdom . | |

OTHER PUBLICATIONS

Patent Abstracts of Japan No. 611 78 402 (Tsutomu), dated Aug. 11, 1986.

Patent Abstracts of Japan No. 610 53 425 (Takafumi), dated Mar. 17, 1986.

"Gas Turbines and Gas Turbine Power Plants", Power for Generations, Siemens, pp. 1–20.

*Primary Examiner*—Ted Kim

*Attorney, Agent, or Firm*—Herbert L. Lerner; Laurence A. Greenberg

[57] ABSTRACT

A burner, particularly for a gas turbine, includes a catalytic combustion chamber and a performer/reformer (24). The combustion chamber has an essentially cylindrical extent in a flow direction of a fuel and a catalytically active coating (12) on a wall facing the fuel for oxidation of the fuel. A particularly low nitrogen oxide content of burner exhaust gas is achieved as a result of the catalytically induced combustion of the fuel. At the same time, in contrast to known primary measures for nitrogen oxide abatement, the flow resistance in the burner is not increased by the coating of the wall. Therefore, when the burner is used in a gas turbine, a particularly high efficiency together with a low nitrogen oxide emission can be achieved.

16 Claims, 2 Drawing Sheets

CATALYTIC COMBUSTION CHAMBER OPERATING ON PREFORMED FUEL, PREFERABLY FOR A GAS TURBINE

CROSS-REFERENCE TO RELATED APPLICATIONS

This application is a continuation of International application Ser. No. PCT/DE96/01020, filed Jun. 11, 1996, which designated the United States.

BACKGROUND OF THE INVENTION

FIELD OF THE INVENTION

The invention relates to a burner, particularly for a gas turbine, with a catalytic combustion chamber. The invention also relates to a gas turbine having the burner.

In such a device, a hydrocarbon and/or a hydrogen-containing energy medium is provided both in liquid and in gaseous form as a fuel. The fuel may be natural gas, petroleum or methane, for example. Such a burner can preferably be used in a gas turbine.

A gas turbine conventionally includes a compressor part, a burner part and a turbine part. The compressor part and the turbine part are usually disposed on a common shaft which at the same time drives a generator for generating electricity. Preheated fresh air is burnt in the compressor part together with a fuel of the above-mentioned type. The hot burner exhaust gas is fed to the turbine part and is expanded there.

Detailed information regarding the structure and use of a gas turbine is found in a company publication entitled "Gas turbines and Gas turbines Power Plants" of Siemens AG, May 1994, Order number A 96001-U 124-V 1-7600.

Nitrogen oxides $NO_x$ also occur as particularly undesirable combustion products in the combustion of a fuel of the type mentioned above. The nitrogen oxides, along with sulfur dioxide, are the main cause of the environmental problem of acid rain. Consequently, as well as in view of strict statutory norms on limit values for the emission of $NO_x$, the aim is to keep the $NO_x$ emission of a gas turbine particularly low and, at the same time, to avoid appreciably influencing the power of the gas turbine.

Thus, for example, a lowering of the flame temperature in the burner has the effect of reducing nitrogen oxide levels. In this case, steam is added to the fuel or to the compressed and preheated fresh air, or water is injected into the combustion space. Such measures, which per se decrease the emission of nitrogen oxides, are referred to as primary measures for the abatement of nitrogen oxides.

Accordingly, the term "secondary measures" is used to describe all of those measures in which nitrogen oxide levels in the exhaust gas, for example of a gas turbine, or basically of a combustion process, are decreased through the use of subsequent measures.

In that respect, the method of selective catalytic reduction (SCR) has gained acceptance throughout the world. In that method, the nitrogen oxides are brought into contact with a reducing agent, usually ammonia, on a catalyst and form nitrogen and water. The use of that technology therefore necessarily entails the consumption of reducing agent. The nitrogen oxide abatement catalysts disposed in the exhaust-gas duct naturally cause a pressure drop which results in a power drop when the burner is used in a turbine. In the case of a gas turbine power of 150 MW, for example, and a retail electricity price of about $0.016/kWh (and about 0.15 DM/kWh in Germany, for example) for electrical energy, even a power drop amounting to a few parts per thousand has a serious effect on the result which can be achieved with such apparatus.

Published UK Patent Application GB 2 268 694 A provides a catalytic combustion chamber as a primary measure for the abatement of nitrogen oxides. The ignition temperature of fuel is lowered through the use of partial catalytic oxidation. The catalysts which are provided for this purpose are installed transversely to the direction of flow of the fuel and extend over the entire flow cross-section. This gives rise to high flow resistance.

Therefore, in the above-described burners, there is basically the problem of any nitrogen oxide abatement of a primary or a secondary nature which is provided there resulting in a power loss or a loss of overall efficiency in the gas turbine plant.

SUMMARY OF THE INVENTION

It is accordingly an object of the invention to provide a burner, particularly for a gas turbine, and a gas turbine having the burner, which overcome the hereinafore-mentioned disadvantages of the heretofore-known devices of this general type and which have particularly low nitrogen oxide emissions and at the same time particularly high efficiency.

With the objects of the invention in view, there is also provided a burner, comprising a catalytic preforming stage for conducting a flow of a fuel partstream therethrough and for at least partly breaking down the fuel into substances igniting readily, in particular alcohols, aldehydes or hydrogen; and a catalytic combustion chamber for receiving a fuel including a main fuel stream, the preformed fuel partstream and air, the combustion chamber having a substantially cylindrical extent in a flow direction of the fuel, a wall facing the fuel and a catalytically active coating on the wall for oxidizing the fuel.

In this way, a particularly low nitrogen oxide content of the burner exhaust gas is achieved as a result of the catalytically induced combustion of the fuel. At the same time, the coating of the wall of the combustion chamber does not entail any increase in the flow resistance, so that particularly high efficiencies can be achieved in a gas turbine with a catalytic combustion chamber of this type. The essentially cylindrical shape of the catalytic combustion chamber and the catalytically active coating of the wall promote ignition of the fuel which starts from the wall, and the possibility of the flame front propagating from the catalytically active surface of the wall into the free flow of the combustion gas. In this case, the cylindrical shape in particular contributes to an essentially concentric and consequently homogeneous distribution of the flame front, thereby resulting in complete and uniform combustion of the fuel.

In accordance with another feature of the invention, there is provided a number of rings, which are concentric with the cylinder longitudinal axis of the combustion chamber and which have a catalytically active coating. This achieves a flame front which has a particularly high degree of rotational symmetry.

In accordance with a further feature of the invention, the process of forming an essentially rotationally symmetrical flame front in the combustion chamber is further assisted if the ring or rings is or are disposed solely in an outer region of the essentially circular cross-section of the combustion chamber.

In order to lower the catalytic ignition temperature of the fuel in the combustion chamber, it is particularly advantageous if a fuel, including a fuel mainstream, a preformed fuel partstream and air, can be fed to the combustion chamber. In this case, the fuel mainstream usually is formed of natural gas and/or coal gas and/or hydrogen. The preformed fuel partstream is a partstream which is separated from the fuel mainstream and which is fed through a preforrming stage. In this preforming stage, which works on the basis of a catalyst, materials, such as alcohols, aldehydes and hydrogen, for example, that ignite catalytically more readily than natural gas are formed, for example from natural gas. A fuel gas to which such a preformed fuel partstream is added therefore has excellent catalytic ignitability.

In accordance with an added feature of the invention, the preformed fuel partstream, premixed with air if appropriate, enters the combustion chamber through bores in the wall.

This embodiment is particularly advantageous with regard to the ignitability of the fuel introduced into the catalytic combustion chamber. In this way, the comparatively readily igniting gas mixture of the preformed fuel partstream is brought directly into contact with the catalytically active coating and ignites spontaneously, so as to produce operationally reliable three-dimensional ignition in the form of a hollow cylinder in the catalytic combustion chamber.

In accordance with an additional feature of the invention, in order to protect the catalytically active coating located on that wall of the catalytic combustion chamber which can face the fuel gas, there can be provision for cooling the wall. In this case, the wall can be cooled, for example, with air, with the air being simultaneously preheated. For example, this preheated air can be subsequently compressed to the combustion-chamber inlet pressure in the compressor part.

In accordance with yet another feature of the invention, the catalytic action of the catalytically active coating occurs particularly advantageously when the catalytically active coating contains titanium dioxide, which is preferably flame-sprayed and plasma-sprayed, and a precious-metal component selected from platinum, rhodium, palladium, iridium, rhenium and/or a metal oxide component having one or more transition metal oxides. Suitable transition metal oxides are oxides which have a highly oxidizing catalytic action, such as, for example, copper oxide, chromium oxide, iron oxide, molybdenum oxide, tungsten oxide, vanadium oxide, manganese oxide, cerium oxide and other lanthanide oxides.

With the objects of the invention in view, there is also provided a gas turbine having the burner.

Other features which are considered as characteristic for the invention are set forth in the appended claims.

Although the invention is illustrated and described herein as embodied in a burner, particularly for a gas turbine, and a gas turbine having the burner, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
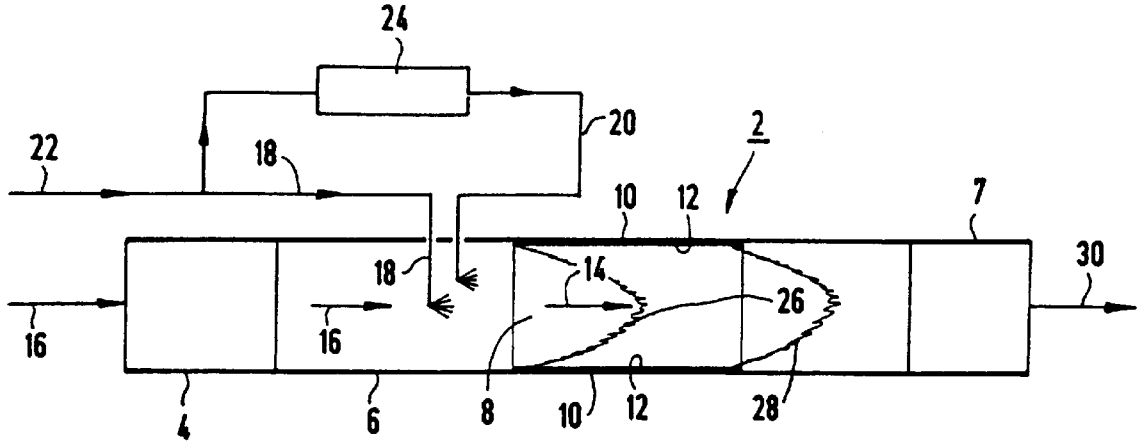
FIG. 1 is a diagrammatic, elevational view of a burner of a gas turbine with a catalytic combustion chamber.

Referring now in detail to the figures of the drawings, in which identical parts have the same reference symbols, and first, particularly, to FIG. 1 thereof, there is seen a diagrammatic representation which of a gas turbine 2 that includes a compressor part 4, a burner part 6 and a turbine part 7. The burner part 6 includes a catalytic combustion chamber 8 having a wall 10 with a catalytically active coating 12.

In the exemplary embodiment, the catalytic combustion chamber 8 has a circular cross-section. In the exemplary embodiment, a fuel gas which flows as a fuel 14 into the catalytic combustion chamber 8 includes air 16 compressed in the compressor part 4, a fuel mainstream 18 and a preformed fuel partstream 20. This preformed fuel partstream 20 is separated from an original fuel stream 22 and fed through a preforming stage 24. In the exemplary embodiment, the fuel stream 22 is natural gas, from which materials such as alcohols, aldehydes and hydrogen, for example, that ignite catalytically more readily than natural gas, are formed in the preforming stage 24. In order to perform its function, the preforming stage 24 includes a non-illustrated ceramic honeycomb catalytic converter which is based on titanium dioxide and which additionally includes a precious-metal component having platinum and palladium applied to the surface of the honeycomb catalyst.

The catalytically active coating 12 on the wall 10 of the catalytic combustion chamber 8 is formed of a flame-sprayed titanium dioxide layer with a thickness of about 500 $\mu$m, to which precious-metal particles of platinum, rhodium and palladium as well as particles of transition metal oxides, such as cerium oxide, vanadium oxide and chromium oxide, are additionally applied. A plasma-sprayed titanium dioxide layer can likewise be provided as an alternative to flame-sprayed titanium dioxide. Both layers are distinguished by their high degree of adhesion to the wall 10 of the catalytic combustion chamber 8. The wall 10 is usually formed of an austenitic steel.

When the gas turbine 2 is in operation, the fuel 14 flows into the catalytic combustion chamber 8 and ignites on the catalytically active coating 12 of the wall 10. An upstream flame front 26 formed thereby and a downstream flame front 28 are essentially rotationally symmetrical, so that the temperature distribution in the catalytic combustion chamber 8 has approximately circular isotherms, in terms of cross section, along the main flow direction. This is advantageous for uniform and low-pollution combustion of the fuel 14.

The fuel 14 which is burnt catalytically in this way enters the turbine part 7 of the gas turbine 2 at a temperature of about 1100° C. and is expanded there. The heat energy which is transferred in the turbine part is utilized for driving a non-illustrated generator for generating electricity. The generator is disposed on the same non-illustrated shaft as the gas turbine 2.

Due to the catalytic combustion of the fuel gas 14, burner exhaust gas 30 leaving the turbine part 7 is particularly low in nitrogen oxides and has a nitrogen oxide content of about 70 ppm. The burner exhaust gas 30 can be utilized for steam generation in a non-illustrated waste-heat steam generator.

Figure 2:
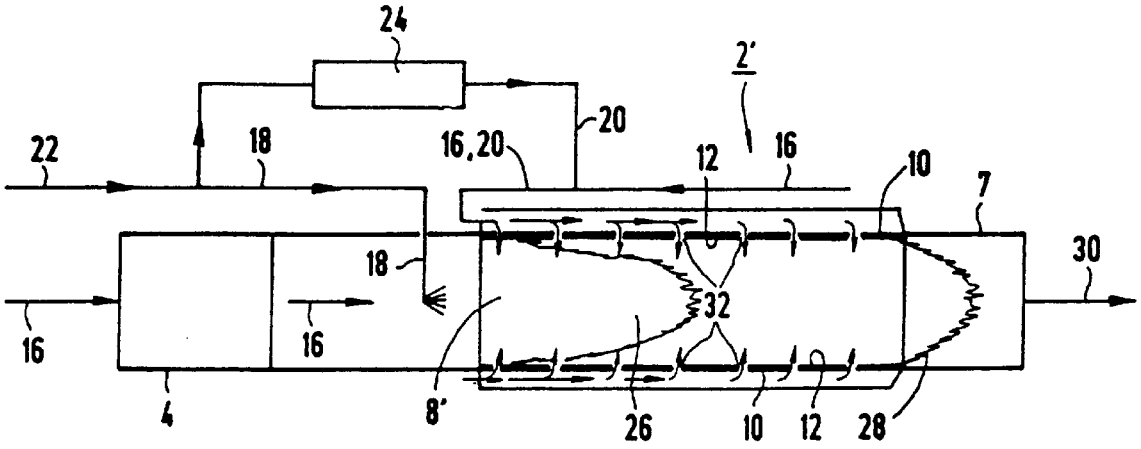
FIG. 2 is an elevational view of the burner of the gas turbine according to FIG. 1, with a catalytic combustion chamber which is slightly modified in relation to FIG. 1.

FIG. 2 shows a diagrammatic representation of a gas turbine 2' which is slightly modified in relation to FIG. 1. In this case, the modifications are restricted to the structure of the catalytic combustion chamber 8. A catalytic combustion chamber 8' which is present in FIG. 2 differs from FIG. 1 in that bores 32, through which the preformed fuel partstream 20 and the air 16 enter the combustion chamber 8', are provided in the wall 10.

This measure has two advantages in comparison with the structure according to FIG. 1. The first advantage is that the fuel mixture having the lowest catalytic ignition temperature enters the combustion chamber 8' directly at the catalytically active coating 12 and therefore ignites comparatively spontaneously. This measure therefore contributes particularly well to stabilizing the upstream flame front 26. The second advantage is that the walls 10 are cooled by the mixture of the preformed fuel partstream 20 and the air 16, with the mixture flowing along them. As a result of this cooling, the thermal load on the catalytically active coating 12 is also reduced, which has a beneficial effect on the durability of the coating 12. Alternatively, cooling of the wall 10 can also be achieved in a non-illustrated manner through the use of a flow of air 16 which enters the compressor part 4.

Figure 3:
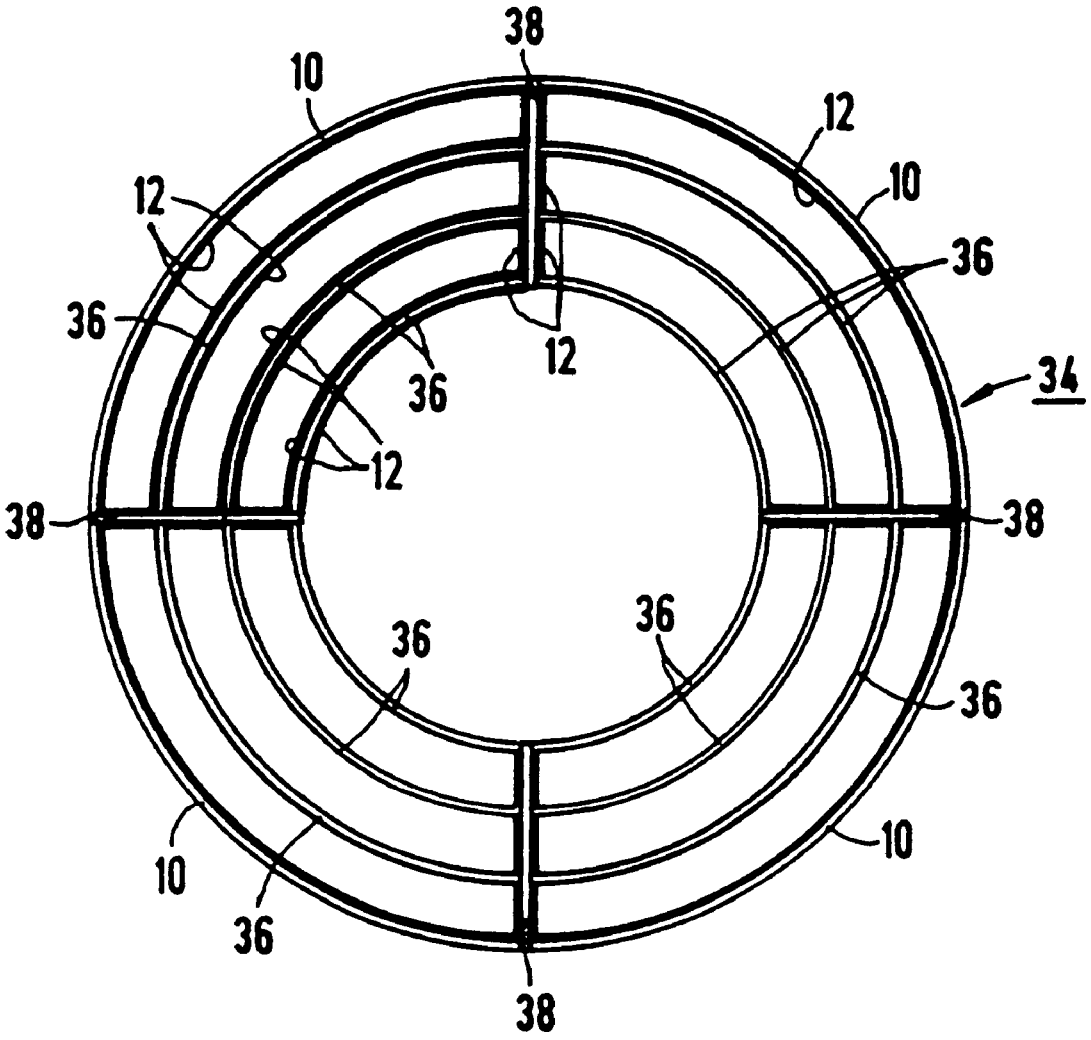
FIG. 3 is a cross-sectional view of a catalytic combustion chamber.

FIG. 3 shows a diagrammatic representation of a cross-section of a catalytic combustion chamber 34 which is modified in relation to FIGS. 1 and 2. The figure once again shows the wall 10 and the catalytically active coating 12 for the oxidation of the fuel 14. The term "oxidation of the fuel" means, of course, that the fuel 14, 22 is oxidized and the oxygen which is supplied by the air 16 and is necessary for combustion, is reduced. The term "catalytically active coating 12 for the oxidation of the fuel gas 14" therefore means the coating which induces the entire combustion process having oxidized and reduced combustion products.

The combustion chamber 34 has three concentrically disposed rings 36. These concentric rings 36 are thin sheet-metal strips being formed of the material of the wall 10. The rings 36 have the same catalytically active coating 12 as the coating with which the wall 10 of the combustion chamber is coated. For the sake of clarity in the representation, the catalytically active coating 12 is marked in only one selected quadrant. Webs 38 holding the rings 36 also have this catalytically active coating 12. The rings 36 are disposed solely in an outer region of the essentially circular cross-section of the combustion chamber 34, in order to restrict the initial ignition of the fuel 14 to the outer region of the cross-section of the combustion chamber 34. Expansion of the flame front into the free flow of the fuel gas 14 then takes place automatically. The rings 36 having the catalytically active coating 12 thus contribute to stabilizing the flame front and to ensuring complete combustion which is therefore particularly low in pollutants.

We claim:

1. A burner, comprising:

a catalytic preforming stage for conducting a flow of a fuel partstream therethrough and for at least partly breaking down the fuel partstream into substances igniting readily; and a catalytic, continuous combustion chamber for receiving a fuel including a main fuel stream, the preformed fuel partstream and air, the preformed fuel partstream being fed directly into said catalytic combustion chamber, said combustion chamber having a substantially cylindrical wall extending in an axial flow direction of the fuel, said wall facing the fuel and having axially spaced bores formed therein for introducing the preformed fuel partstream through said bores into said combustion chamber and a catalytically active coating on said wall for oxidizing the fuel.

2. The burner according to claim 1, wherein said catalytic preforming stage breaks down the fuel into substances selected from the group consisting of alcohols, aldehydes and hydrogen.

3. The burner according to claim 1, wherein said combustion chamber has a longitudinal cylinder axis and a number of catalytically actively coated rings disposed concentrically to the longitudinal cylinder axis.

4. The burner according to claim 3, wherein said combustion chamber has a substantially circular cross section with an outer region, and at least one of said rings is disposed exclusively in said outer region.

5. The burner according to claim 1, wherein the preformed fuel partstream is premixed with air.

6. The burner according to claim 1, wherein said wall is cooled.

7. The burner according to claim 1, wherein said catalytically active coating includes sprayed titanium dioxide, a noble metal component selected from at least one noble metal in the group consisting of platinum, rhodium, palladium, iridium, rhenium, and a metal oxide component selected from at least one transition metal oxide.

8. The burner according to claim 7, wherein said titanium dioxide is flame-sprayed.

9. The burner according to claim 7, wherein said titanium dioxide is plasma-sprayed.

10. The burner according to claim 1, wherein said catalytically active coating includes sprayed titanium dioxide and a noble metal component selected from at least one noble metal in the group consisting of platinum, rhodium, palladium, iridium, rhenium.

11. The burner according to claim 10, wherein said titanium dioxide is flame-sprayed.

12. The burner according to claim 10, wherein said titanium dioxide is plasma-sprayed.

13. The burner according to claim 1, wherein said catalytically active coating includes sprayed titanium dioxide and a metal oxide component selected from at least one transition metal oxide.

14. The burner according to claim 13, wherein said titanium dioxide is flame-sprayed.

15. The burner according to claim 13, wherein said titanium dioxide is plasma-sprayed.

16. A gas turbine, comprising:

a burner including:

a catalytic preforming stage for conducting a flow of a fuel partstream therethrough and for at least partly breaking down the fuel partstream into substances igniting readily; and a catalytic combustion chamber for receiving a fuel including a main fuel stream, the preformed fuel partstream and air, the preformed fuel partstream being fed directly into said catalytic combustion chamber, said combustion chamber having a substantially cylindrical wall extending in an axial flow direction of the fuel, said wall facing the fuel and having axially spaced bores formed therein for introducing the preformed fuel partstream through said bores into said combustion chamber and a catalytically active coating on said wall for oxidizing the fuel.

* * * * *